US008519692B2

(12) United States Patent
Nakashima

(10) Patent No.: US 8,519,692 B2
(45) Date of Patent: Aug. 27, 2013

(54) VOLTAGE REGULATOR

(75) Inventor: Shingo Nakashima, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 603 days.

(21) Appl. No.: 12/633,390

(22) Filed: Dec. 8, 2009

(65) Prior Publication Data

US 2010/0148742 A1 Jun. 17, 2010

(30) Foreign Application Priority Data

Dec. 11, 2008 (JP) ..... 2008-315896

(51) Int. Cl.
*G05F 1/56* (2006.01)
*G05F 1/565* (2006.01)
*G05F 1/569* (2006.01)

(52) U.S. Cl.
USPC ..... 323/288; 323/349

(58) Field of Classification Search
USPC ..... 323/210, 211, 273–285, 288, 318, 323/349
See application file for complete search history.

(56) References Cited

U.S. PATENT DOCUMENTS 4,908,566 A * 3/1990 Tesch ..... 323/280
5,686,820 A * 11/1997 Riggio, Jr. ..... 323/273
5,689,460 A 11/1997 Ooishi
5,881,014 A 3/1999 Ooishi
5,905,371 A * 5/1999 Limpaecher ..... 323/288
5,920,185 A 7/1999 Ozoe
6,049,200 A * 4/2000 Hayashimoto ..... 323/269
6,066,943 A * 5/2000 Hastings et al. ..... 323/285
6,072,742 A 6/2000 Ooishi
6,191,536 B1 * 2/2001 Dolmovich ..... 315/209 CD
6,424,585 B1 7/2002 Ooishi
6,600,294 B1 * 7/2003 DiPiazza ..... 323/212
6,828,763 B2 * 12/2004 Sudou et al. ..... 323/226
7,002,321 B2 * 2/2006 McDaniel et al. ..... 323/211
7,088,082 B2 * 8/2006 Jung ..... 323/275
7,622,902 B1 * 11/2009 Kao et al. ..... 323/276
7,956,588 B2 * 6/2011 Imura ..... 323/274
8,085,018 B2 * 12/2011 Nihei et al. ..... 323/280
2001/0028240 A1 * 10/2001 Fukui ..... 323/280

(Continued)

FOREIGN PATENT DOCUMENTS

JP 5-127763 5/1993
JP 8-190437 A 7/1996

(Continued)

*Primary Examiner* — Jeffrey L. Sterrett
*Assistant Examiner* — Nusrat Quddus
(74) *Attorney, Agent, or Firm* — Foley & Lardner LLP

(57) ABSTRACT

An output voltage of a voltage regulator is set to within a prescribed voltage range in a short time. The voltage regulator comprises: an amplifier (AMP) that amplifies a difference between a reference voltage and a voltage proportional to an output voltage; an NMOS transistor (MN1) that has a control terminal connected to an output terminal of the amplifier (AMP) and that drops a power supply voltage to output an output voltage; a first capacitive element (C1) that has a first terminal connected to the output terminal of the amplifier (AMP) and a second terminal connected to ground; a second capacitive element (C2) that has a first terminal connected to the output terminal of the amplifier (AMP); and a control circuit (11) that, subsequent to supply of the power supply voltage, controls operation activation of the amplifier (AMP) and also supplies a drive signal to a second terminal of the second capacitive element (C2).

9 Claims, 10 Drawing Sheets

(56) References Cited

U.S. PATENT DOCUMENTS

| | | | | |
|---|---|---|---|---|
| 2004/0104711 | A1* | 6/2004 | Scoones et al. | 323/280 |
| 2004/0150483 | A1* | 8/2004 | Cho | 331/117 R |
| 2004/0239301 | A1* | 12/2004 | Kobayashi | 323/284 |
| 2005/0088153 | A1* | 4/2005 | Suzuki | 323/274 |
| 2005/0162141 | A1* | 7/2005 | Kanakubo | 323/274 |
| 2005/0184711 | A1* | 8/2005 | Chen et al. | 323/280 |
| 2005/0248325 | A1* | 11/2005 | Adachi | 323/273 |
| 2006/0255772 | A1* | 11/2006 | Chen | 323/205 |
| 2007/0159146 | A1* | 7/2007 | Mandal | 323/280 |
| 2007/0188155 | A1* | 8/2007 | Oki et al. | 323/280 |
| 2007/0241728 | A1* | 10/2007 | Demolli | 323/273 |
| 2008/0024096 | A1* | 1/2008 | Pan | 323/271 |
| 2008/0157735 | A1* | 7/2008 | Liu et al. | 323/280 |
| 2008/0174288 | A1* | 7/2008 | Poles et al. | 323/273 |
| 2010/0019742 | A1* | 1/2010 | Li et al. | 323/234 |

FOREIGN PATENT DOCUMENTS

| | | | |
|---|---|---|---|
| JP | 10-214121 | A | 8/1998 |
| JP | 2002-312042 | A | 10/2002 |
| JP | 2007-335648 | A | 12/2007 |

* cited by examiner

VOLTAGE REGULATOR

REFERENCE TO RELATED APPLICATION

This application is based upon and claims the benefit of the priority of Japanese patent application No. 2008-315896, filed on Dec. 11, 2008, the disclosure of which is incorporated herein in its entirety by reference thereto.

TECHNICAL FIELD

The present invention relates to a voltage regulator, and in particular to activation control technology for a voltage regulator.

BACKGROUND

Accompanying semiconductor process miniaturization, there is a tendency for current consumed by semiconductor devices to increase. Therefore, in order to reduce the consumption current of a semiconductor device, technology is being used to reduce voltage supplied to internal circuitry of the semiconductor device by using a voltage regulator. Until output voltage of the voltage regulator settles into a prescribed voltage range, the internal circuitry cannot operate normally, and it is necessary to wait until the internal circuitry reaches the prescribed voltage range. Accordingly, speeding up of time for activating the voltage regulator is desired.

Patent Document 1 discloses a voltage regulator for speeding up time for activating. This voltage regulator is provided with a reference voltage circuit, an error amplifier, and an output transistor wherein a field-effect transistor is source-follower connected, and wherein a gate of the output transistor is connected to output of the error amplifier, and a pre-charge circuit is connected to a gate of the output transistor. Here, a phase correction capacitor is connected to the gate of the output transistor, and the pre-charge circuit pre-charges the phase correction capacitor by a transistor that is ON when power is turned on. Therefore, when power is turned on, output of the voltage regulator increases instantaneously.

[Patent Document 1]

JP Patent Kokai Publication No. JP-A-5-127763

SUMMARY

The entire disclosure of Patent Document 1 is incorporated herein by reference thereto.

The following analysis is given by the present invention.

In a conventional voltage regulator, when power is turned on, a gate of an output transistor has a potential the same as the level of a voltage Vin of an external power supply, and an output voltage Vout has a voltage that is lower than a voltage of the gate of the output transistor by about a threshold voltage (Vtn) of the output transistor. That is, the output voltage Vout immediately after the power is turned on is represented by the following expression.

$$Vout = Vin - Vtn \tag{1}$$

After Vout increases to a voltage indicated by expression (1), it decreases to an output voltage level (Vc) when voltages of an inverting terminal and a non-inverting terminal of an error amplifier are approximately the same. Time t until the voltage decreases from the voltage Vout to the voltage Vc that is stable is determined by a load current Iout that flows from output of the voltage regulator and a load capacitance (Cout) added to the output, and is represented by the following expression.

$$t = \frac{Cout \times (Vout - Vc)}{Iout} \tag{2}$$

Accordingly, in a case where the load capacitance added to the output is large and the current flowing from the output is small, time for the output voltage Vout to decrease to the voltage Vc becomes long. Accordingly there is much to be desired in the art.

According to a first aspect of the present invention, there is provided with a voltage regulator comprising: an amplifier that amplifies a difference between a reference voltage and a voltage proportional to an output voltage; an output MOS transistor that has a control terminal connected to an output terminal of the amplifier and that drops a power supply voltage to output an output voltage. A first capacitive element has a first terminal connected to the output terminal of the amplifier and a second terminal connected to ground or an output terminal of the output MOS transistor. A second capacitive element has a first terminal connected to the output terminal of the amplifier. A control circuit, subsequent to supply of the power supply voltage, controls operation activation of the amplifier and also supplies a drive signal to a second terminal of the second capacitive element.

The meritorious effects of the present invention are summarized as follows.

According to the present invention, it is possible to set an output voltage of the voltage regulator to within a prescribed voltage range in a short time.

PREFERRED MODES

Figure 1:
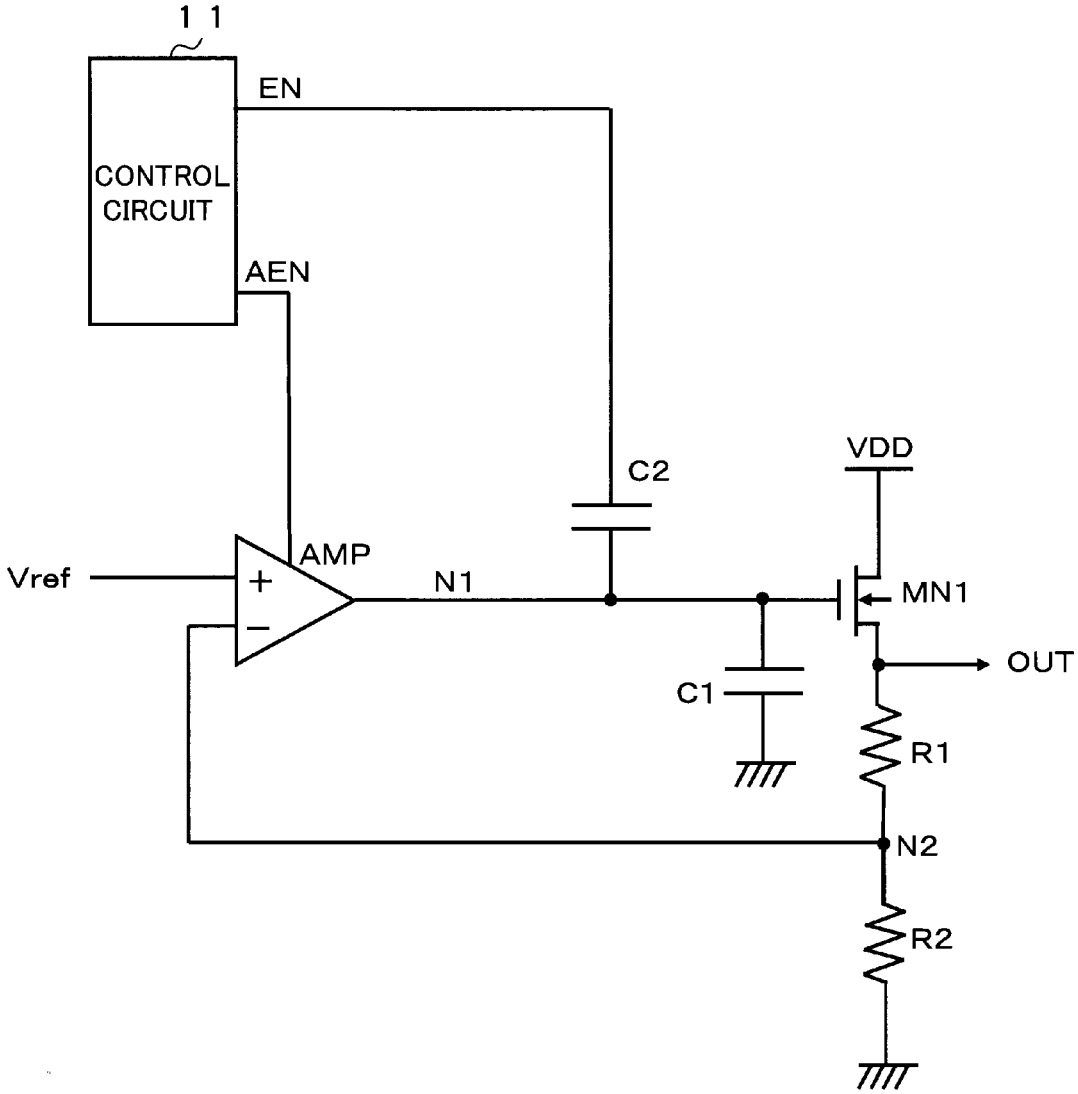
FIG. 1 is a circuit diagram of a voltage regulator according to a first exemplary embodiment of the present invention.

A voltage regulator according to an embodiment of the present invention is provided with: an amplifier (AMP in FIG. 1) that amplifies a difference between a reference voltage and a voltage proportional to an output voltage; an output MOS transistor (MN1 in FIG. 1) that has a control terminal connected to an output terminal of the amplifier and that drops a power supply voltage to output an output voltage; a first capacitive element (C1 in FIG. 1) that has a first terminal connected to the output terminal of the amplifier and a second terminal connected to ground or an output terminal of the output MOS transistor; a second capacitive element (C2 in FIG. 1) that has a first terminal connected to the output terminal of the amplifier; and a control circuit (11 in FIG. 1) that, subsequent to supply of the power supply voltage, controls operation activation of the amplifier and also supplies a drive signal to a second terminal of the second capacitive element.

According to the above type of voltage regulator, a gate voltage of the output MOS transistor of the voltage regulator when the voltage regulator is activated is determined by a capacitance ratio between the first capacitive element and the second capacitive element. Therefore, it is possible to suppress increasing of the output voltage and to set the output voltage of the voltage regulator to within a prescribed voltage range in a short time.

Furthermore, when the voltage regulator is activated, since the output voltage of the voltage regulator is determined by the capacitance ratio between the first capacitive element and the second capacitive element, an input power supply voltage of the voltage regulator is not directly applied to an internal circuit connected to output of the voltage regulator when the power supply is activated. Therefore, even in a case where withstanding (breakdown) voltage of the internal circuit is low, it is possible to prevent damage to the internal circuit.

The voltage regulator of the present invention may be configured as follows.

The capacitance ratio of the first and the second capacitive elements, in a steady state, is preferably set based on voltage of an output terminal of the amplifier.

The first and the second capacitive elements have a function of phase compensation with regard to amplification operation by the amplifier and the output MOS transistor.

The output MOS transistor may be an N type; the power supply voltage may be supplied to a drain thereof; the output voltage may be outputted from a source; and the first capacitive element may have the second terminal grounded.

The output MOS transistor may be a P type; the power supply voltage may be supplied to the source thereof; the output voltage may be outputted from the drain; and the first capacitive element may have the second terminal connected to an output terminal of the output MOS transistor.

With a resistance element provided, and by the control circuit supplying a drive signal to the second terminal of the second capacitive element, the second capacitive element may be charged and discharged, and discharging may be performed via the resistance element.

By additionally providing i-th capacitive element(s) (i=3 to n, with n being an integer of at least 3) having a first terminal connected to an output terminal of the amplifier, the control circuit, after operation activation of the amplifier, may supply drive signals, each at different timing, to respective second terminals of the second to n-th capacitive elements.

The control circuit may supply drive signals selectively to the respective second terminals of the second to n-th capacitive elements.

A ratio between the sum of capacitances of the second to n-th capacitive elements having an activated drive signal and capacitance of the first capacitive element may be set based on the voltage of the output terminal of the amplifier in a steady state.

The first to n-th capacitive elements may have a function of phase compensation with regard to amplification operation by the amplifier and the output MOS transistor.

By the control circuit supplying a drive signal to the respective second terminals of the second to n-th capacitive elements, the second to n-th capacitive elements may be charged and each discharged at different timing.

With a resistance element provided, the control circuit may discharge at least one of the second to n-th capacitive elements via the resistance element.

A detailed description is given below according to exemplary embodiments, making reference to the drawings.

First Exemplary Embodiment

FIG. 1 is a circuit diagram of a voltage regulator according to a first exemplary embodiment of the present invention. In FIG. 1, the voltage regulator is provided with a control circuit 11, an amplifier AMP, capacitive elements C1 and C2, an NMOS transistor MN1, and resistance elements R1 and R2.

A positive (+) side input of the amplifier AMP is connected to a reference power supply Vref, and a negative (−) side input is connected to a node N2 between feedback resistance element R1 and resistance element R2, and the amplifier functions as an error amplifier. The resistance element R2 is grounded on a different side from the node N2. The NMOS transistor MN1 has a drain connected to a power supply VDD, a source connected to a different side from the node N2 of the resistance element R1 as output OUT, and a gate connected to output (node N1) of the amplifier AMP. The capacitive element C1 for phase compensation is connected between output of the amplifier AMP and GND.

The control circuit 11 supplies a signal AEN, indicating operation activation of the amplifier AMP, to the amplifier AMP, and supplies a signal EN to a second terminal of the capacitive element C2 that has a first terminal connected to the node N1.

In the voltage regulator of the above type of configuration, since the amplifier AMP operates so that the voltage of the node N2 and the reference power supply Vref have the same potential, a voltage level Vc of the node N1 after sufficient time has elapsed after activating the voltage regulator can be represented by the following expression.

$$Vc = \left(1 + \frac{R1}{R2}\right) \times VREF \tag{3}$$

Figure 2:
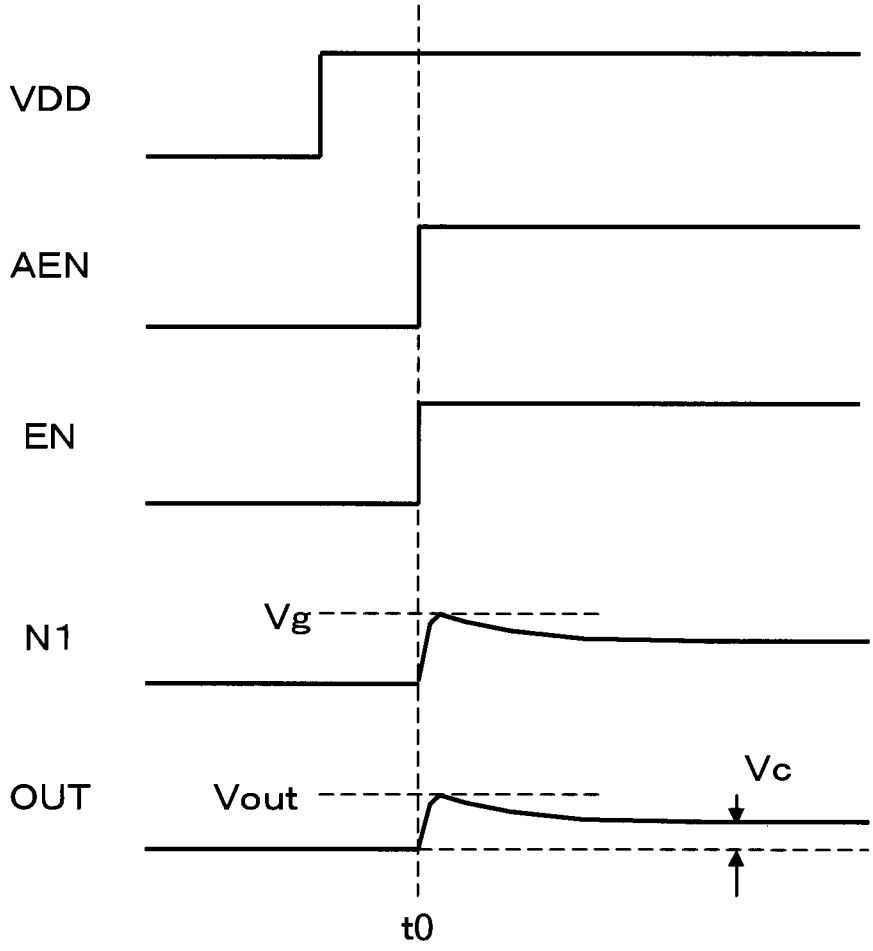
FIG. 2 is a timing chart of each part of the voltage regulator according to the first exemplary embodiment of the present invention.

FIG. 2 is a timing chart of each part of the voltage regulator according to the first exemplary embodiment. The power supply VDD is inputted before time t0. Furthermore, an initial voltage of the node N1, which is output of the amplifier AMP, is discharged to 0V. The control circuit 11 makes the amplifier AMP operate by making the control signal AEN go from a low level to a high level at time t0. Furthermore, the control circuit 11 changes the voltage of the control signal EN from 0 to VDD. In this case, the voltage Vg of the node N1 immediately after time t0 is driven by divided voltage of the capacitive elements C1 and C2, and is represented by the following expression.

$$Vg = VDD \times \frac{C2}{C1 + C2} \tag{4}$$

The voltage Vout of the output OUT is a voltage that is lower than the voltage of the node N1 by a threshold voltage Vtn of the NMOS transistor MN1. Therefore, the voltage Vout immediately after time t0 is represented by the following expression.

$$Vout = VDD \times \frac{C2}{C1 + C2} - Vtn \tag{5}$$

Thereafter, the voltage Vout varies until a steady level Vc is reached. In a case where the voltage Vout has been set higher than the voltage Vc, time t (time for activating) of a drop from the voltage Vout immediately after activating the voltage regulator as far as the voltage Vc is determined by a current Iout flowing from the output OUT and a load capacitance Cout added to the output OUT, and is represented by the following expression.

$$t = \frac{Cout \times (Vout - Vc)}{Iout} \tag{6}$$

The voltage Vout immediately after time t0 can be regulated by the capacitance ratio of the first capacitive element C1 and the second capacitive element C2 as indicated in expression (5). Therefore, by determining an appropriate value for the capacitance ratio of the first capacitive element C1 and the second capacitive element C2, it is possible to shorten the time t for activating the voltage regulator.

A specific example of shortening the activating time is described using expression (2) and expressions (5) and (6), as indicated in conventional technology. Variables used in the expressions (2), (5), and (6) take the following values: VDD=5V, Vc=2V, Vtn=0.8V, C1=4 pF, C2=6 pF, Iout=10 μA, and Cout=100 pF In a case of the conventional technology, substituting constants given as described above for the variables in expression (2), the activating time t is represented by the following expression.

$$t = \frac{100\ \text{pF} \times (5V - 0.8V - 2V)}{10uA} = 22us \tag{7}$$

In a case of the conventional technology, substituting constants given as described above for the variables in expression (5), the output voltage Vout is represented by the following expression.

$$Vout = 5V \times \frac{6\ \text{pF}}{4\ \text{pF} + 6\ \text{pF}} - 0.8V = 2.2V \tag{8}$$

Therefore, in a case of the present exemplary embodiment, substituting constants and Vout=2.2V given as described above for the variables in expression (6), the activating time t is represented by the following expression.

$$t = \frac{100\ \text{pF} \times (2.2V - 2V)}{10uA} = 2us \tag{9}$$

As described above, in the voltage regulator of the present exemplary embodiment, the activating time can be shortened from 22 μs of the conventional technology to 2 μs.

Furthermore, according to the voltage regulator of the present exemplary embodiment, as indicated in expression (5), it is possible to regulate the output voltage level immediately after activating the voltage regulator by the capacitance ratio of the capacitive elements C1 and C2 connected to an output transistor of the voltage regulator. Therefore, it is possible to suppress rising of the output voltage when the voltage regulator is activated. In this way, the voltage of a device such as a transistor or the like constituting an internal circuit connected to output of the voltage regulator is suppressed, and it is possible to prevent damage to elements constituting the internal circuit.

In addition, according to the voltage regulator of the present exemplary embodiment, a pre-charge circuit used in conventional circuits is unnecessary. Furthermore, since the capacitive element C2 that receives the control signal EN functions to provide phase compensation capacitance, a total capacitance connected to the amplifier AMP that is the same as a conventional circuit is adequate. Therefore, in comparison to a conventional circuit, size of the voltage regulator can be made small.

Second Exemplary Embodiment

Figure 3:
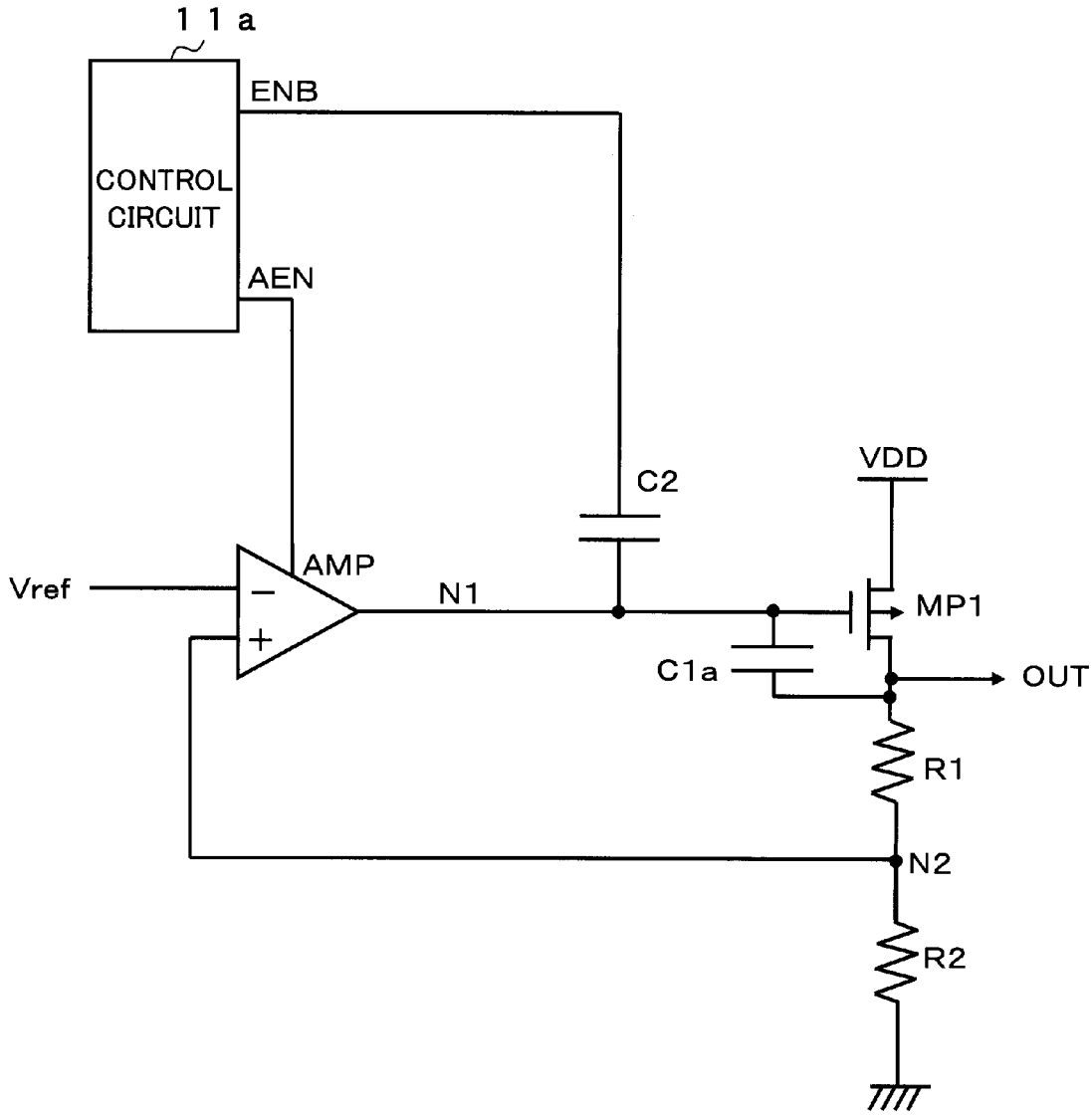
FIG. 3 is a circuit diagram of the voltage regulator according to a second exemplary embodiment of the present invention.

FIG. 3 is a circuit diagram of a voltage regulator according to a second exemplary embodiment of the present invention. In FIG. 3, reference symbols the same as in FIG. 1 represent the same items and descriptions thereof are omitted.

In an amplifier AMP, a reference power supply Vref is connected to a negative side input, and a node N2 is connected between a resistance element R1 and a resistance element R2 at a positive side input. Furthermore, a PMOS transistor MP1 has a source connected to a power supply VDD, a drain connected to a different side from the node N2 of the resistance element R1 as output OUT, and a gate connected to output (node N1) of the amplifier AMP. A capacitive element C1*a* for phase compensation is connected between the node N1 and output OUT. Furthermore, a control circuit 11*a* supplies a signal AEN indicating operation activation of the amplifier AMP, to the amplifier AMP, and supplies a signal ENB to a second terminal of a capacitive element C2 that has a first terminal connected to the node N1.

Next, operation of the voltage regulator according to the present exemplary embodiment is described. Since the amplifier AMP operates so that a reference power supply Vref and a voltage of the node N2 have the same potential, a voltage level of output OUT, after sufficient time has elapsed after activating the voltage regulator, is represented similarly to expression (3) described in the first exemplary embodiment.

Figure 4:
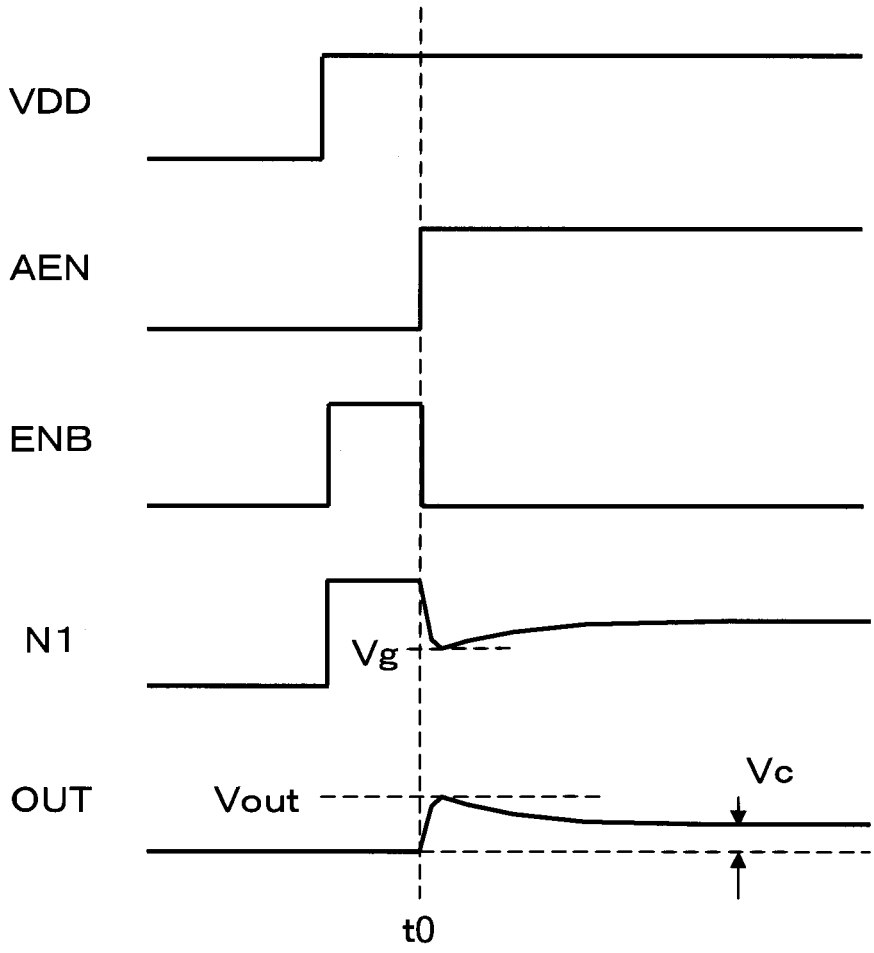
FIG. 4 is a timing chart of each part of the voltage regulator according to the second exemplary embodiment of the present invention.

FIG. 4 is a timing chart of each part of the voltage regulator according to the second exemplary embodiment. The power supply VDD is inputted before time t0. Furthermore, at the same time as input of the power supply VDD, an initial voltage of the output node N1 of the amplifier AMP is set to the voltage of the power supply VDD, and the PMOS transistor MP1 is OFF. At time t0, the amplifier AMP is made to operate by making a control signal AEN go from a low level to a high level, and voltage of the control signal ENB is changed by the voltage of the power supply VDD only, in a minus direction. In this case, the voltage Vg of the node N1 immediately after time t0 is represented by the following expression.

$$Vg = VDD - VDD \times \frac{C2}{C1 + C2} \quad (10)$$

Here, since 0<VDD, a range of Vg is given by Vg<VDD.

In this state, assuming that the PMOS transistor MP1 is operating in a saturated region, and with a threshold voltage of the PMOS transistor MP1 as Vtp, a current Ids flowing in the PMOS transistor MP1 is represented by the following expression.

$$Ids = K(Vg - VDD - Vtp)^2 \quad (11)$$

Here, K indicates a proportionality constant determined by transistor size and manufacturing process.

On the other hand, a time-period tr until the voltage of the output OUT reaches a prescribed voltage Vc is represented by the following expression, where a load capacitance added to the output OUT is Cout.

$$tr = \frac{Cout \times Vc}{Ids} \quad (12)$$

Substituting expression (11) into expression (12), the time tr is as in the following expression.

$$tr = \frac{Cout \times Vc}{K(Vg - VDD - Vtp)^2} \quad (13)$$

According to expression (13), in a case where the voltage Vg of the node N1, immediately after time t0, is set high (however, Vg<VDD), since tr becomes long, the time for activating the voltage regulator becomes long. On the other hand, in a case where the voltage Vg of the node N1, immediately after time t0, is set low, tr becomes short.

In the conventional technology it was not possible to regulate the voltage level of the voltage Vout immediately after activating the voltage regulator. In the present exemplary embodiment, as shown in expression (10) and expression (13), it is possible to regulate the voltage Vout immediately after time t0 by the capacitance ratio of the capacitive elements C1 and C2. Therefore, by applying the present invention and determining an appropriate value for the capacitance ratio of the first capacitive element C1 and the second capacitive element C2, it is possible to shorten the time for activating the voltage regulator.

In the present exemplary embodiment, a capacitive element C1*a* for phase compensation is connected between the output OUT and the node N1 of output of the amplifier AMP. There is no limitation to this, and in a case also where the capacitive element C1*a* is between GND and the node N1, it also has a function to provide phase compensation capacitance, and has an effect the same as that described in the first exemplary embodiment.

As described above, in a case where an output transistor of the voltage regulator is a P-type transistor, it is also possible to speed up the activating time.

Third Exemplary Embodiment

Figure 5:
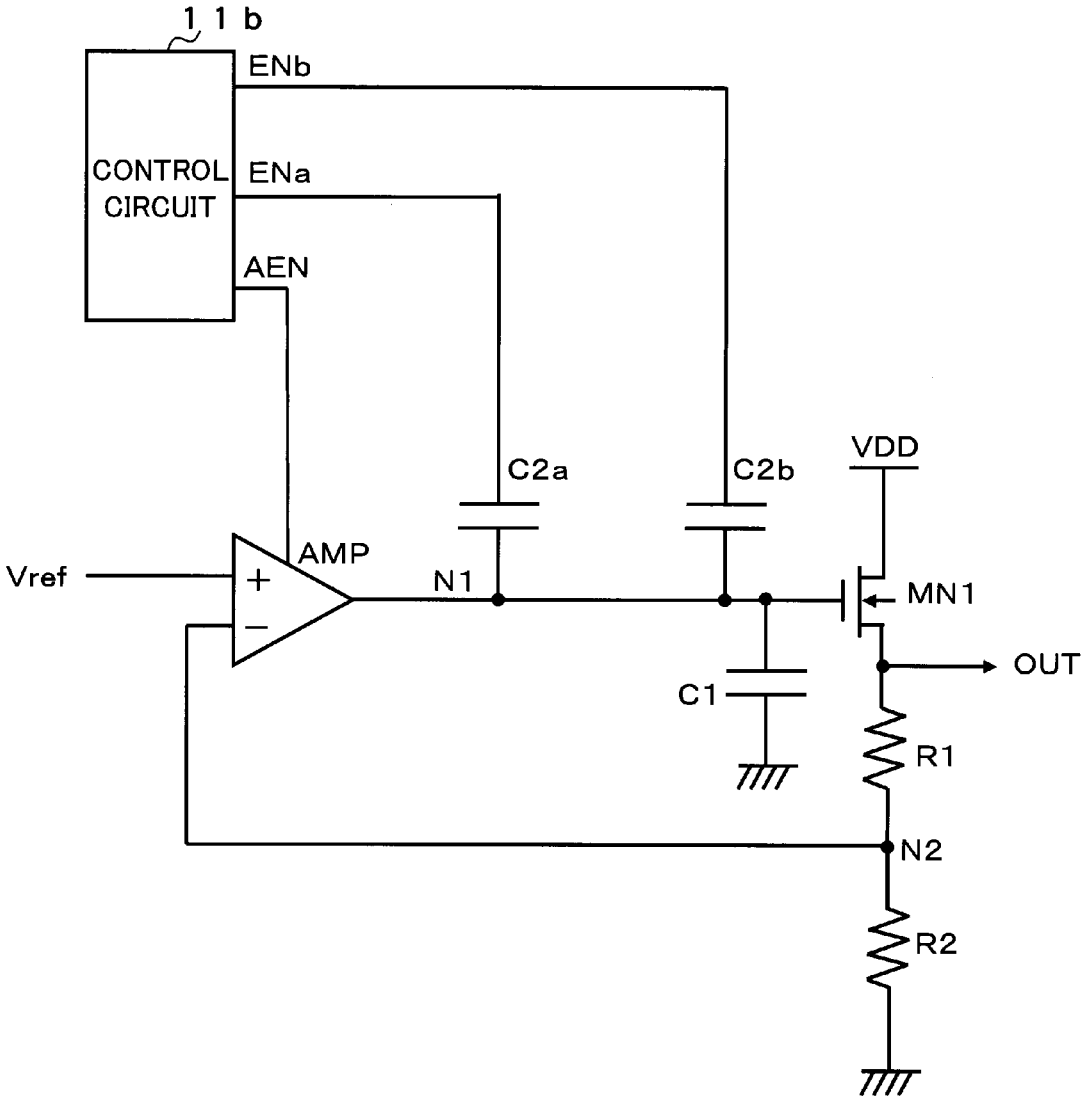
FIG. 5 is a circuit diagram of the voltage regulator according to a third exemplary embodiment of the present invention.

FIG. 5 is a circuit diagram of a voltage regulator according to a third exemplary embodiment of the present invention. In FIG. 5, reference symbols the same as in FIG. 1 represent the same items and descriptions thereof are omitted. The voltage regulator is provided with capacitive elements C2*a* and C2*b* that have first terminals connected to a node N1, instead of a capacitive element C2. A control circuit 11*b* supplies signals ENa and ENb to second terminals of the capacitive elements C2*a* and C2*b*, respectively.

Figure 6:
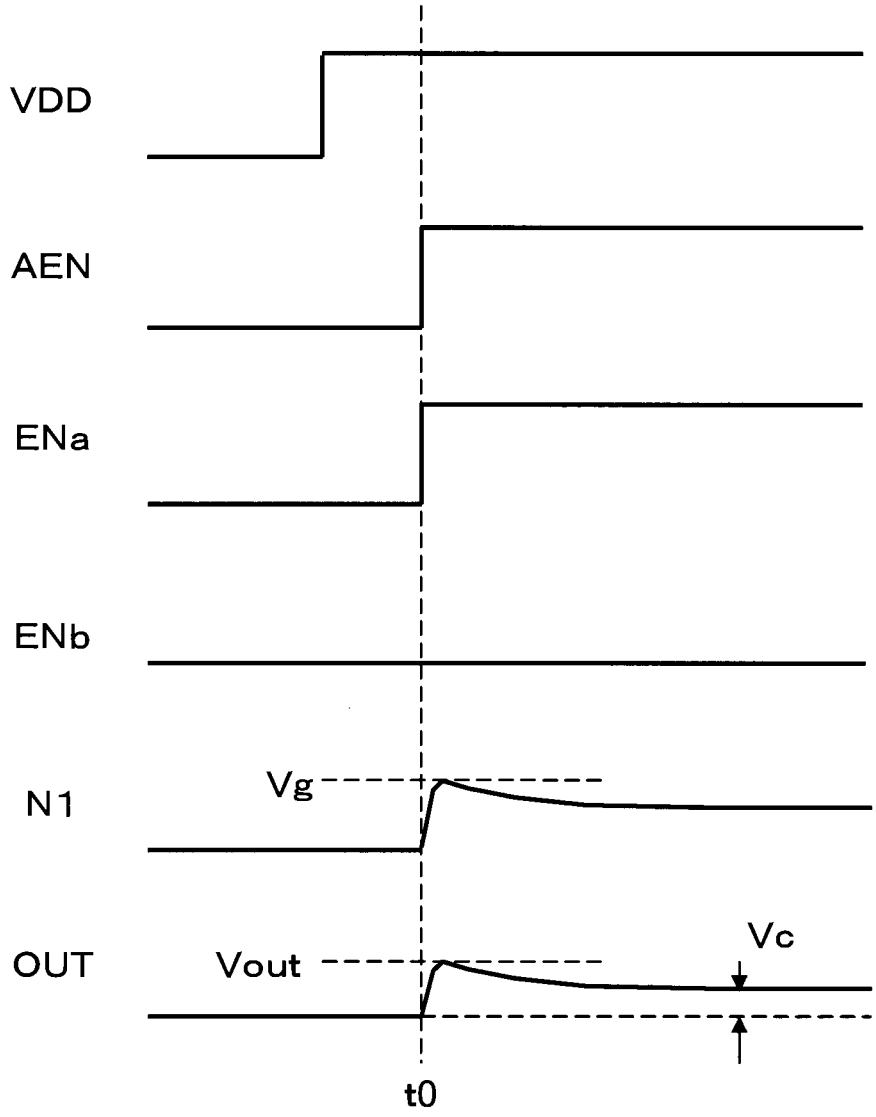
FIG. 6 is a timing chart of each part of the voltage regulator according to the third exemplary embodiment of the present invention.

Next, operation of the voltage regulator according to the present exemplary embodiment is described. FIG. 6 is a timing chart of each part of the voltage regulator according to the third exemplary embodiment. A power supply VDD is inputted before time t0. Furthermore, an initial voltage of the node N1, which is output of an amplifier AMP, is discharged to 0V. The control circuit 11*b* makes the amplifier AMP operate by making a control signal AEN go from a low level to a high level at time t0. Furthermore, the control circuit 11*b* fixes the control signal ENb to a constant voltage (0V), and changes the voltage of the control signal ENa at time t0 from 0 to VDD. In this case, a voltage Vg of the node N1 immediately after time t0 is represented by the following expression.

$$Vg = VDD \times \frac{C2a}{C1 + C2a + C2b} \quad (14)$$

On the other hand, in a case where the control signal ENa is fixed to a constant voltage (0V), and the voltage of the control signal ENb is changed by VDD only, at time t0, the voltage Vg of the node N1 immediately after time t0 is represented by the following expression.

$$Vg = VDD \times \frac{C2b}{C1 + C2a + C2b} \quad (15)$$

In addition, in a case where the voltages of the control signals ENa and ENb are changed by only VDD at time t0, the voltage Vg of the node N1 immediately after time t0 is represented by the following expression.

$$Vg = VDD \times \frac{C2a + C2b}{C1 + C2a + C2b} \quad (16)$$

As shown in expressions (14), (15), and (16), by regulating capacitance ratio of capacitive elements that perform control by changing voltage by the control circuit 11*b*, it is possible to set a plurality of output voltage levels immediately after activating the voltage regulator. As a result, even in a case where voltage amplitude of a control signal changes, by regulating the number of capacitive elements that perform control by changing voltage by the control circuit 11*b*, it is possible to regulate gate voltage immediately after activating the voltage regulator. That is, by regulating the number of capacitive elements that perform control by changing voltage by the control circuit 11*b*, it is possible to set a control voltage range of the control signals of the voltage regulator to a wide range.

Fourth Exemplary Embodiment

Figure 7:
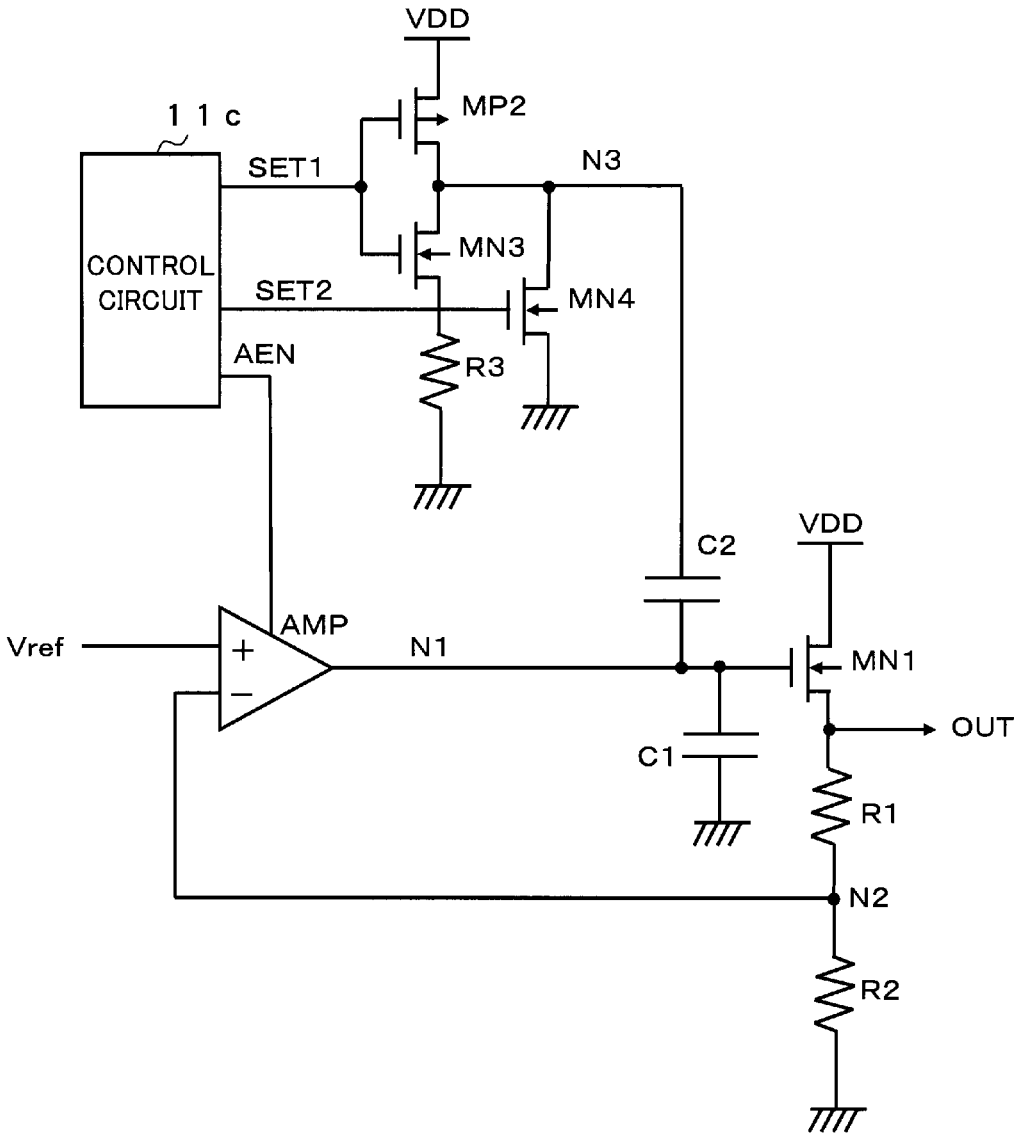
FIG. 7 is a circuit diagram of the voltage regulator according to a fourth exemplary embodiment of the present invention.

FIG. 7 is a circuit diagram of a voltage regulator according to a fourth exemplary embodiment of the present invention. In FIG. 7, reference symbols the same as in FIG. 1 represent the same items and descriptions thereof are omitted. The voltage regulator, compared to FIG. 1, is further provided with a PMOS transistor MP2, NMOS transistors MN3 and MN4, and a resistance element R3.

The PMOS transistor MP2 has a source connected to a power supply VDD, and a drain connected to a node N3. The NMOS transistor MN3 has a source grounded via the resistance element R3, and a drain connected to the node N3. The NMOS transistor MN4 has a source grounded, and a drain connected to the node N3. A capacitive element C2 is connected between the node N3, which is an output of a transistor group controlled by a control circuit 11*c*, and a node N1, which is an output of an amplifier AMP. The control circuit 11*c* supplies a signal SET1 to a gate of the PMOS transistor MP2 and a gate of the NMOS transistor MN3, and supplies a signal SET2 to a gate of the NMOS transistor MN4.

Figure 8:
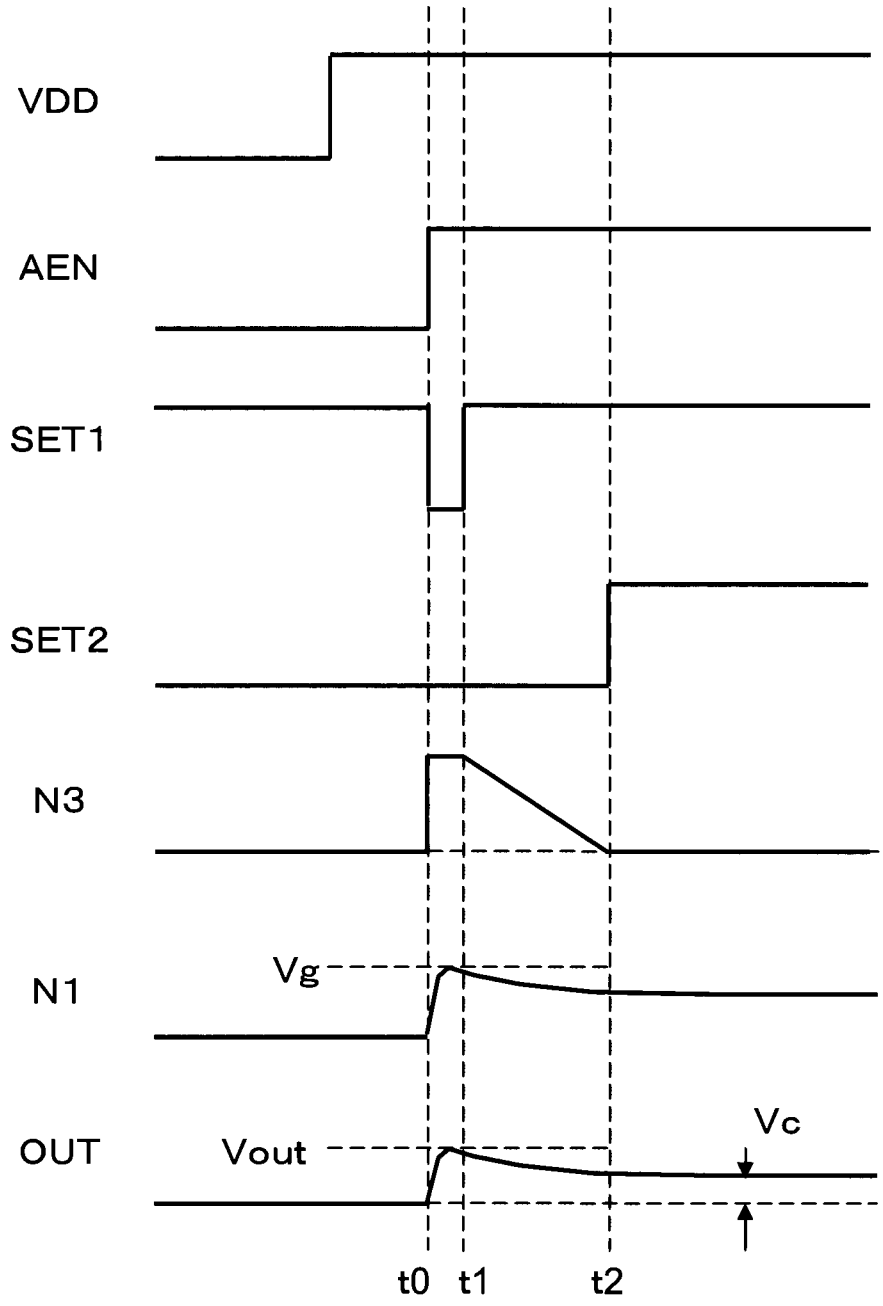
FIG. 8 is a timing chart of each part of the voltage regulator according to the fourth exemplary embodiment of the present invention.

Next, operation of the voltage regulator according to the present exemplary embodiment is described. FIG. 8 is a timing chart of each part of the voltage regulator according to the fourth exemplary embodiment. A power supply VDD is inputted before time t0. Furthermore, an initial voltage of the node N1, which is output of an amplifier AMP, is discharged to 0V. The control circuit 11*c* makes the amplifier AMP operate by making a control signal AEN go from a low level to a high level at time t0. In addition, the control circuit 11*c* sets a control signal SET2 to a low level. When the voltage of a control signal SET1 is changed from a high level to a low level at time t0, the PMOS transistor MP2 is ON, and the voltage of the node N3 changes from a low level to a high level. Therefore, a voltage Vg of the node N1 immediately after time t0 is the same as in the first exemplary embodiment, and time for activating the voltage regulator is the same as in the first exemplary embodiment.

Next, a description is given of operation after output OUT of the voltage regulator has converged to an output voltage that is stable, that is, after activating the voltage regulator. After activating the voltage regulator, the control signal SET1 is changed from a low level to a high level at time t1. In this way, the PMOS transistor MP2 is OFF, and the NMOS transistor MN3 is ON. When the NMOS transistor MN3 is ON, a charge at the node N3 is discharged to GND via the NMOS transistor MN3 and the resistance element R3, and the voltage of the node N3 is 0V. Speed at which the charge of the node N3 discharges is proportional to a time constant of load capacitance and load resistance of a discharge path from the node N3 to GND. After the charge of the node N3 has become 0V, the control signal SET2 is changed from a low level to a high level at time t2, and the NMOS transistor MN4 is turned ON.

In the first exemplary embodiment, when power supply voltage that generates a signal fluctuates, the control signal EN of FIG. 1, after activating the voltage regulator, is affected by the power supply voltage fluctuation. As a result, by coupling of the capacitive element C2 and noise of the signal EN, the node N1 is affected by the power supply voltage fluctuation, and the output OUT is affected by the power supply voltage change.

In general, comparing power supply VDD fluctuation range and GND fluctuation range, the fluctuation range of GND is smaller. In this case, as in the present exemplary embodiment, by turning the NMOS transistor MN4 ON after activating the voltage regulator, it is possible to fix the node N3 at GND level, and to strengthen noise tolerance of output voltage with regard to the power supply fluctuation. Therefore, in comparison to the first exemplary embodiment, it is possible to further improve the noise tolerance of the output voltage with regard to the power supply fluctuation after activating the voltage regulator.

Furthermore, by gradually dropping the voltage of the node N3, it is possible to ease transient voltage fluctuation of the output voltage. Since the speed at which the charge of the node N3 discharges is proportional to a time constant of the load capacitance and the load resistance of the discharge path from the node N3 to GND, by making a resistance value of the resistance element R3 large, it is possible to gradually drop the voltage of the node N3. However, there is a demerit in that if the resistance value of the resistance element R3 becomes large, impedance of the node N3 becomes high, and a high-frequency response characteristic of the capacitive element C2 deteriorates. In the present exemplary embodiment, in order to ameliorate this demerit, the signal SET2 is controlled after the level of the node N3 has dropped to GND level, and the NMOS transistor MN4 is turned ON. In this way, the impedance of the node N3 is lowered. Therefore, it is possible to improve the high-frequency response characteristic of the capacitive element C2.

Fifth Exemplary Embodiment

Figure 9:
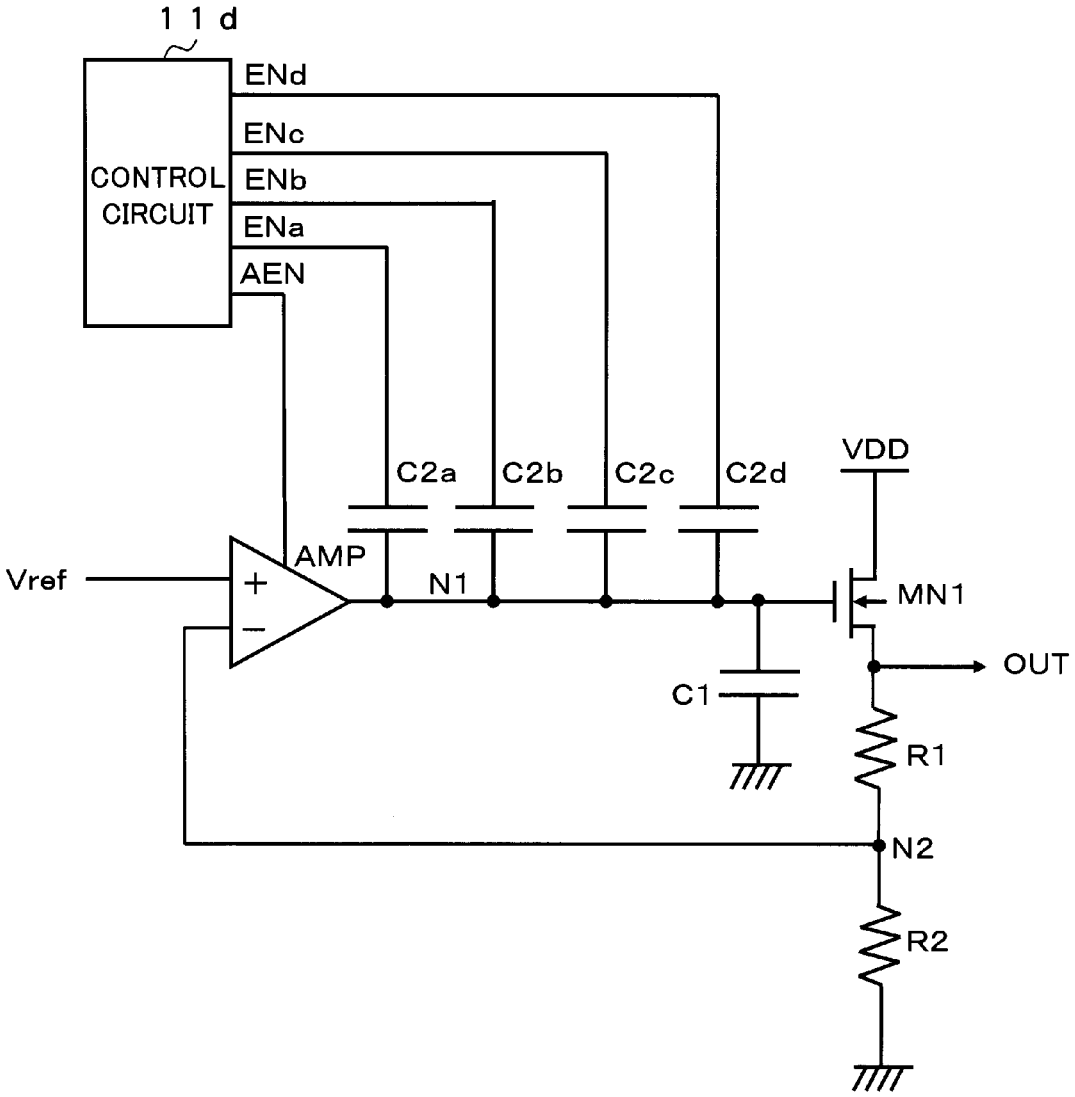
FIG. 9 is a circuit diagram of the voltage regulator according to a fifth exemplary embodiment of the present invention.

FIG. 9 is a circuit diagram of a voltage regulator according to a fifth exemplary embodiment of the present invention. In FIG. 9, reference symbols the same as in FIG. 5 represent the same items and descriptions thereof are omitted. Comparing with FIG. 5, the voltage regulator is further provided with capacitive elements C2*c* and C2*d* having first terminals connected to a node N1. A control circuit 11*d* supplies signals ENc and ENd to second terminals of the capacitive elements C2*c* and C2*d*, respectively.

Figure 10:
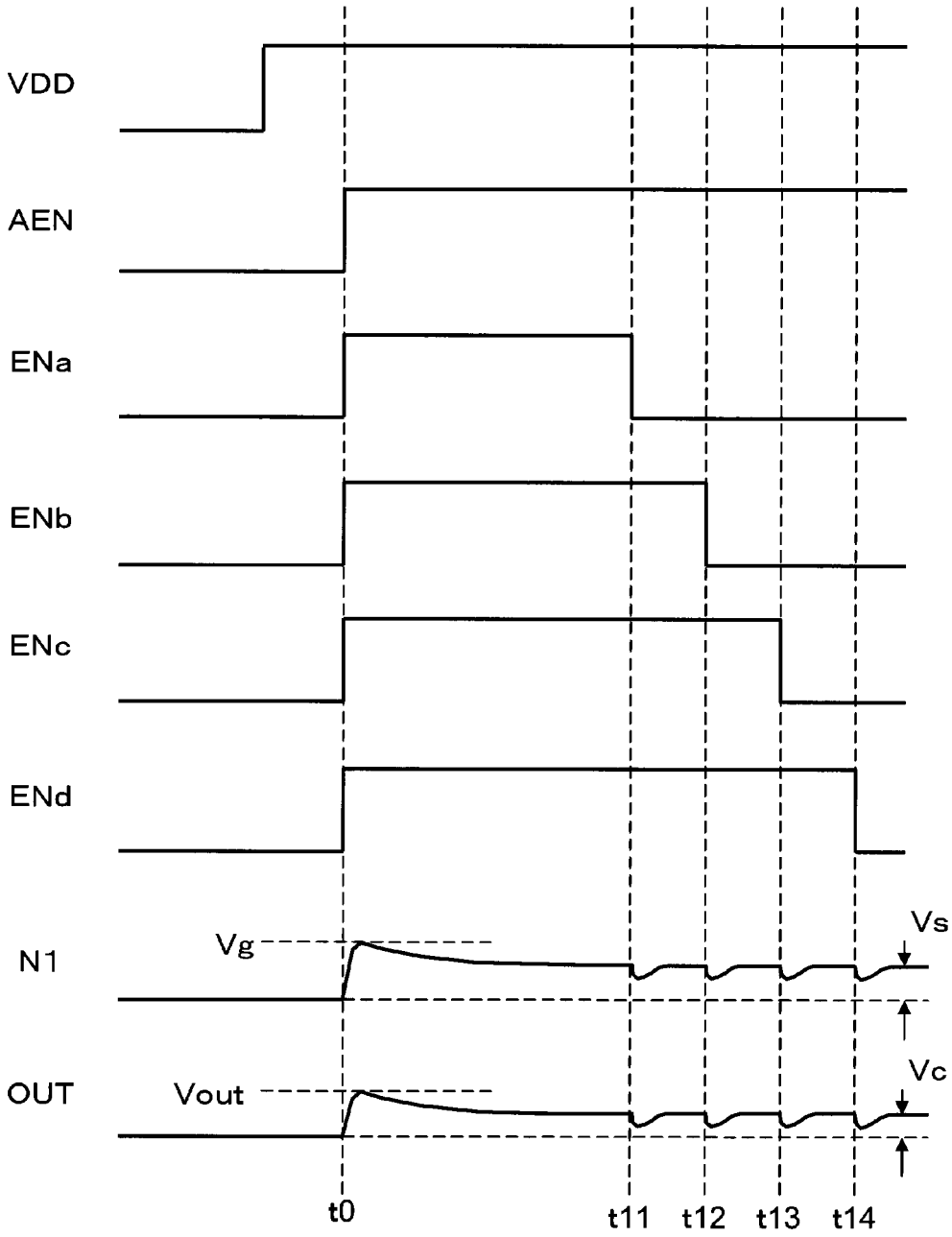
FIG. 10 is a timing chart of each part of the voltage regulator according to the fifth exemplary embodiment of the present invention.

Next, operation of the voltage regulator according to the present exemplary embodiment is described. FIG. 10 is a timing chart of each part of the voltage regulator according to the fifth exemplary embodiment. An initial voltage of the output node N1 of an amplifier AMP is discharged to 0V. Furthermore, a power supply VDD is inputted before time t0, and the amplifier AMP is activated by controlling a control signal AEN before time t0. At time t0, by changing voltage of control signals ENa, ENb, ENc, and ENd from a low level to a high level at the same time, and having voltage change amount thereof as VDD, a voltage Vg of the node N1 immediately after time t0 is represented by the following expression.

$$Vg = VDD \times \frac{C2a + C2b + C2c + C2d}{C1 + C2a + C2b + C2c + C2d} \tag{17}$$

If the sum of the capacitance values of C2*a*, C2*b*, C2*c*, and C2*d* is the same as C2, the time for activating the voltage regulator is equal to that of the first exemplary embodiment. Operation up to here is the same as that of the third exemplary embodiment.

Next, a description is given of operation after output OUT of the voltage regulator has converged to an output voltage that is stable, that is, after activating the voltage regulator. After activating the voltage regulator, a stable voltage of the output node N1 of the amplifier AMP is Vs.

After activating the voltage regulator, the control signal ENa is changed from a high level to a low level at time t11. In a case where voltage change amount of the control signal ENa is VDD, the voltage drop of the node N1 at timing immediately after time t11 is represented by the following expression.

$$Vg = Vs - VDD \times \frac{C2a}{C1 + C2a + C2b + C2c + C2d} \quad (18)$$

Since the voltage of the output OUT is a voltage lower than the voltage of the node N1 by about a threshold voltage Vtn of an NMOS transistor MN1, the voltage Vout of the output OUT immediately after time t11 is represented by the following expression.

$$Vout = Vs - VDD \times \frac{C2a}{C1 + C2a + C2b + C2c + C2d} - Vtn \quad (19)$$

By expression (19), the output OUT drops in proportion to the capacitive element C2*a*, and thereafter, the voltage of the node N1 converges to a stable voltage Vs by a feedback operation of the amplifier AMP, and the voltage of the output OUT converges to a stable voltage Vc.

After that, the control signal ENb is changed from a high level to a low level at time t12. In this way, the voltage Vout of the output OUT immediately after time t12 is represented by the following expression.

$$Vout = Vs - VDD \times \frac{C2b}{C1 + C2a + C2b + C2c + C2d} - Vtn \quad (20)$$

From expression (20), the output node N1 drops in proportion to the capacitive element C2*b*, but the voltage of the node N1 converges to the stable voltage Vs by a feedback operation of the amplifier AMP, and the output OUT converges to the stable voltage Vc.

Thereafter, similar to control of the control signals ENa and ENb, the control signal ENc is changed from a high level to a low level at time t13, and after the voltage of the output OUT has converged to the stable voltage Vc, the control signal ENd is changed from a high level to a low level at time t14.

As described in the fourth exemplary embodiment, in general by switching a signal to GND level after activating the voltage regulator, it is often possible to strengthen noise tolerance of the output voltage with regard to power supply fluctuation. But in a case where a control signal connected to each capacitance, after activating the voltage regulator, is precipitously changed to GND level, the voltage drop of the node N1 is large in proportion to a controlling capacitance value. In this case, there is a possibility of the voltage drop of the output OUT becoming large, and that an internal circuit connected to the output OUT will no longer operate normally.

According to the voltage regulator of the present exemplary embodiment, after activating the voltage regulator, the control signal is transitioned to GND level by time division. By decreasing the controlling capacitance value as shown in expressions (19) and (20), it is possible to make the voltage drop in the output OUT small. Therefore, it is possible to limit the output voltage drop of the voltage regulator at a prescribed timing, and finally it is possible to transition the control signal connected to each capacitance to GND level.

According to the voltage regulator of the present exemplary embodiment as described above, it is possible to strengthen the noise tolerance of the output voltage with regard to power supply fluctuation after activating the voltage regulator, by a method different to the fourth exemplary embodiment.

Each disclosure of the abovementioned patent document is incorporated herein by reference thereto. Modifications and adjustments of embodiments and examples are possible within the bounds of the entire disclosure (including the scope of the claims) of the present invention, and also based on fundamental technological concepts thereof. Furthermore, a wide variety of combinations and selections of various disclosed elements are possible within the scope of the claims of the present invention. That is, the present invention clearly includes every type of transformation and modification that a person skilled in the art can realize according to technological concepts and the entire disclosure including the scope of the claims.

What is claimed is:

1. A voltage regulator comprising:

an amplifier that amplifies a difference between a reference voltage and a voltage proportional to an output voltage;

an output MOS transistor that has a control terminal connected to an output terminal of said amplifier and that drops a power supply voltage to output an output voltage;

a first capacitive element that has a first terminal connected to said output terminal of said amplifier and a second terminal connected to ground or an output terminal of said output MOS transistor;

a second capacitive element that has a first terminal connected to said output terminal of said amplifier;

a control circuit that, subsequent to supply of said power supply voltage, controls operation activation of said amplifier and also supplies a drive signal to a second terminal of said second capacitive element; and i-th capacitive element(s) (i=3 to n, with n being an integer of at least 3) having a first terminal connected to an output terminal of said amplifier; wherein said control circuit, after operation activation of said amplifier, supplies drive signals, each of different timing, to a second to n-th of said capacitive elements, respectively.

2. The voltage regulator according to claim 1, wherein said control circuit supplies drive signals selectively to the second to n-th of said capacitive elements respectively.

3. The voltage regulator according to claim 1, wherein a ratio between a total capacitance of the second to n-th of said capacitive elements having said drive signals activated, and capacitance of said first capacitive element, is set based on the voltage of said output terminal of said amplifier in a steady state.

4. The voltage regulator according to claim 1, wherein the first to n-th of said capacitive elements have a function of phase compensation with regard to amplification operation by said amplifier and said output MOS transistor.

5. The voltage regulator according to claim 1, wherein, by said control circuit supplying a drive signal to second terminals of each of the second to n-th of said capacitive elements, the second to n-th of said capacitive elements are charged and each discharged at different timing.

6. The voltage regulator according to claim 5, comprising a resistance element; wherein said control circuit discharges at least one of the second to n-th of said capacitive elements via said resistance element.

7. The voltage regulator according to claim 2, wherein, by said control circuit supplying a drive signal to second terminals of each of the second to n-th of said capacitive elements, the second to n-th of said capacitive elements are charged and each discharged at different timing.

8. The voltage regulator according to claim 7, comprising a resistance element; wherein said control circuit discharges at least one of the second to n-th of said capacitive elements via said resistance element.

9. A voltage regulator comprising:

an amplifier that amplifies a difference between a reference voltage and a voltage proportional to an output voltage;

an output transistor that includes a control terminal connected to an output terminal of the amplifier and that drops a power supply voltage to output the output voltage;

a controller that is free from connecting to an output terminal of the output transistor, the output terminal of the output transistor outputting the output voltage;

a first capacitor that is connected to the output terminal of the amplifier; and a second capacitor that is connected between the output terminal of the amplifier and the controller, wherein the controller controls operation activation of the amplifier, and supplies a drive signal to the second capacitor, wherein the drive signal comprises a first drive signal, wherein the voltage regulator further comprises:

a third capacitor that is connected between the output terminal of the amplifier and the controller, wherein the controller supplies a second drive signal different from the first drive signal to the third capacitor.

* * * * *